US006098236A

United States Patent [19]

Chen

[11] Patent Number: 6,098,236

[45] Date of Patent: Aug. 8, 2000

[54] BATH STRIP

[76] Inventor: Ching-Chen Chen, No. 552, Kuang Fu Rd., Pei Tou, Chang Hua Hsien, Taiwan

[21] Appl. No.: 09/248,974

[22] Filed: Feb. 12, 1999

[51] Int. Cl.[7] ..... A47K 7/02

[52] U.S. Cl. ..... 15/222; 15/209.1

[58] Field of Search ..... 15/209.1, 222, 15/229.11, 229.12, 229.13; 300/21

[56] References Cited

U.S. PATENT DOCUMENTS 5,560,071 10/1996 Chang ..... 15/222
5,802,659 9/1998 Chang ..... 15/222
5,850,662 12/1998 Galvan-Garza ..... 15/222
5,893,823 4/1999 Li ..... 15/222
5,947,564 10/1996 Chen ..... 15/229.11

*Primary Examiner*—Terrence R. Till
*Attorney, Agent, or Firm*—Dougherty & Troxell

[57] ABSTRACT

A bath strip which includes an elastic tube of net transversely stretched, two first flexible binding elements inserted through the elastic tube of net and tied up, forming two loop-like handle means at two opposite ends of the transversely stretched elastic tube of net, and a plurality of second flexible binding elements respectively wound round the transversely stretched elastic tube of net and tied up, separating the transversely stretched elastic tube of net into a longitudinal series of spherical portions.

6 Claims, 3 Drawing Sheets

BATH STRIP

BACKGROUND OF THE INVENTION

The present invention relates to bath strips, and more particularly to such a bath strip which is formed of a transversely stretched elastic tube of net and bound Lip by flexible binding elements.

Various strip-like bathing implements have been disclosed, and have appeared on the market. U.S. Pat. No. 5,560,071 discloses a similar design. According to this design, cylindrical elastic nets are squeezed and shortened, and then connected in parallel, forming a string of balls. This bathing implement manufacturing process is complicated, and not suitable for mass production to lower the manufacturing cost. Furthermore, because the connecting area between each two adjacent balls is rigid and exposed to the outside, it causes the user to feel uncomfortable when the user rubs the bathing implement over the body.

SUMMARY OF THE INVENTION

It is one object of the present invention to provide a bathing strip which is easy and inexpensive to manufacture. It is another object of the present invention to provide a bathing strip which is comfortable in use. To achieve these and other objects of the present invention, there is provided a bath strip comprised of an elastic tube of net transversely stretched, two first flexible binding elements inserted through the elastic tube of net and tied up, forming two loop-like handle means at two opposite ends of the transversely stretched elastic tube of net, and a plurality of second flexible binding elements respectively wound round the transversely stretched elastic tube of net and tied up, separating the transversely stretched elastic tube of net into a longitudinal series of spherical portions. In an alternate form of the present invention, pluralities of tubes of net of different colors are arranged together, and bound up with flexible binding elements.

DETAILED DESCRIPTION OF THE PREFERRED EMBODIMENT

Figure 1:
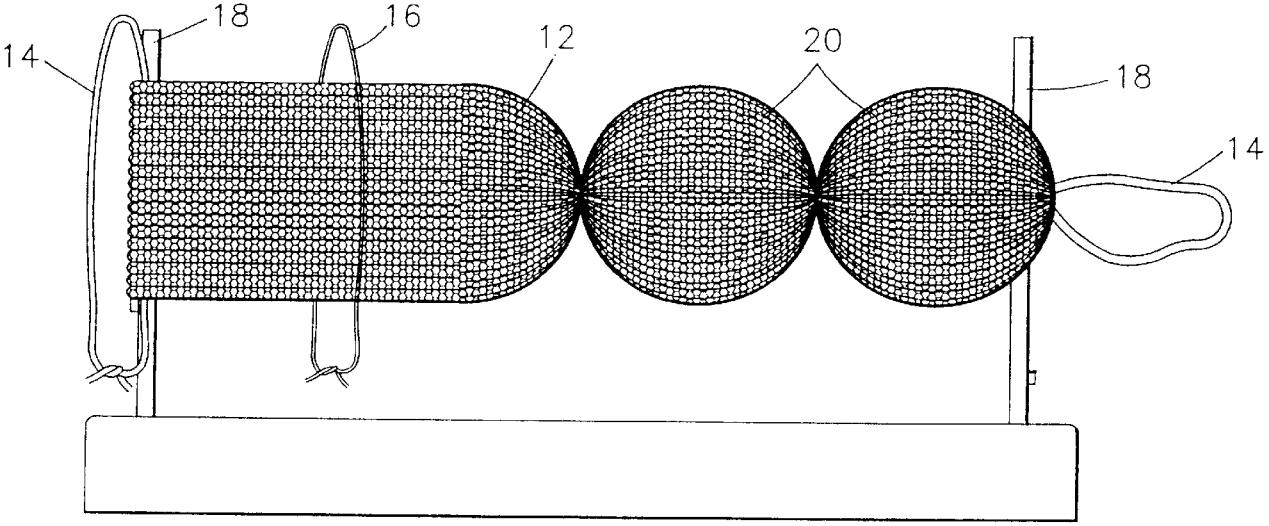
FIG. 1 illustrates a tube of net transversely stretched and pulled over two fixed upright rods, first and second binding elements fastened to the transversely stretched tube of net according to the present invention.
Figure 2:
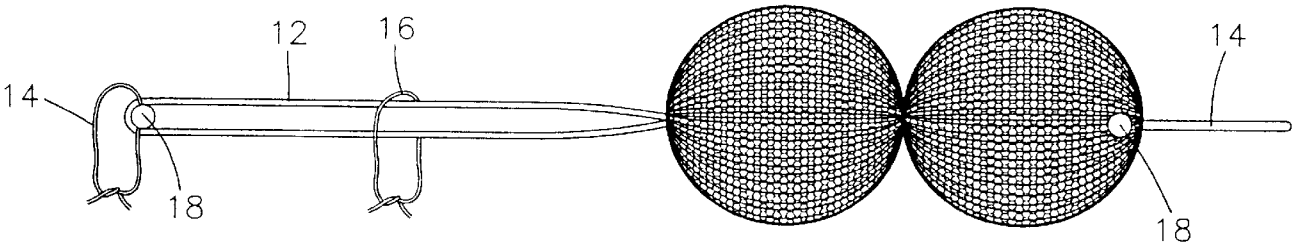
FIG. 2 is a top view of FIG. 1.
Figure 3:
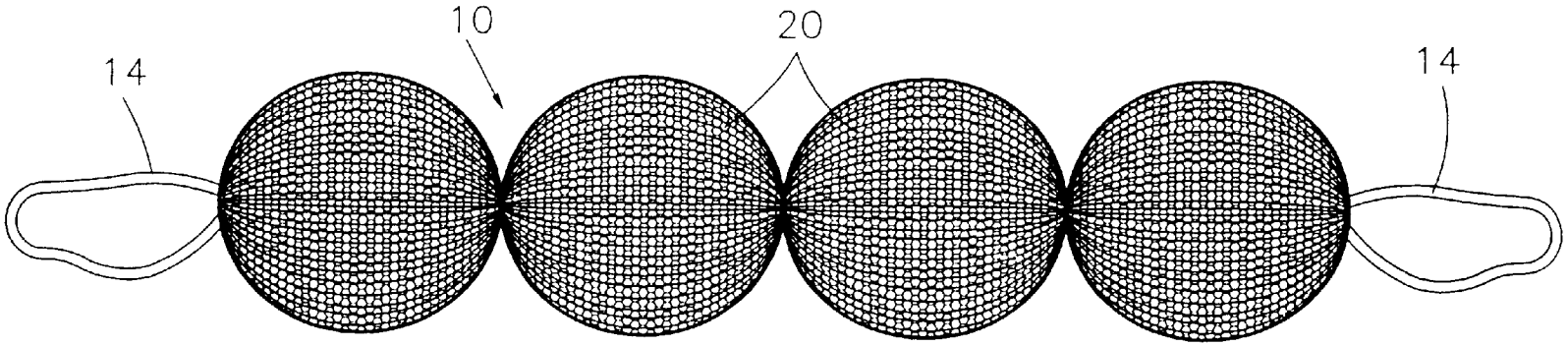
FIG. 3 is a perspective front view of a bath strip according to a first embodiment of the present invention.

Referring to Figures from 1 through 3, a bath strip 10 in accordance with the present invention is generally comprised of a tube of net 12, two first binding elements 14, and three-second binding elements 16.

The tube of net 12 is a loop-like elastic member made from plastic material having a certain length, a certain size, and a certain elasticity, and a plurality of rhombic (or rectangular) open spaces in it. The tube of net 12 is stretched transversely, then loaded onto two horizontally spaced, fixed upright rods 18, enabling the fixed upright rods 18 to be inserted into the center hole of the tube of net 12 and then pulled downwards. When the tube of net 12 is pulled over the fixed upright rods 18, its periphery is corrugated, and its dimension is reduced, forming a cylindrical shape. The two first binding elements 14 are respectively inserted through the transversely stretched tube of net 12, then turned backwards and hung on the tube of net 12 at two opposite sides, and then respectively fastened up, forming two handles at two opposite ends of the transversely stretched tube of net 12. The user can select binding elements 14 and 16 from any of a variety of rope-like materials subject to the desired thickness and softness. After installation of the first binding elements 14, the second binding elements 16 are respectively wound round the transversely stretched tube of net 12 and equally spaced between the first binding elements 14, and then respectively tied up. The second binding elements 16 are equally spaced between the first binding elements 14. When the tube of net 12 is removed from the fixed upright rods 18, a finished bath strip 10 is obtained comprised of a series of spherical portions 20.

Figure 4:
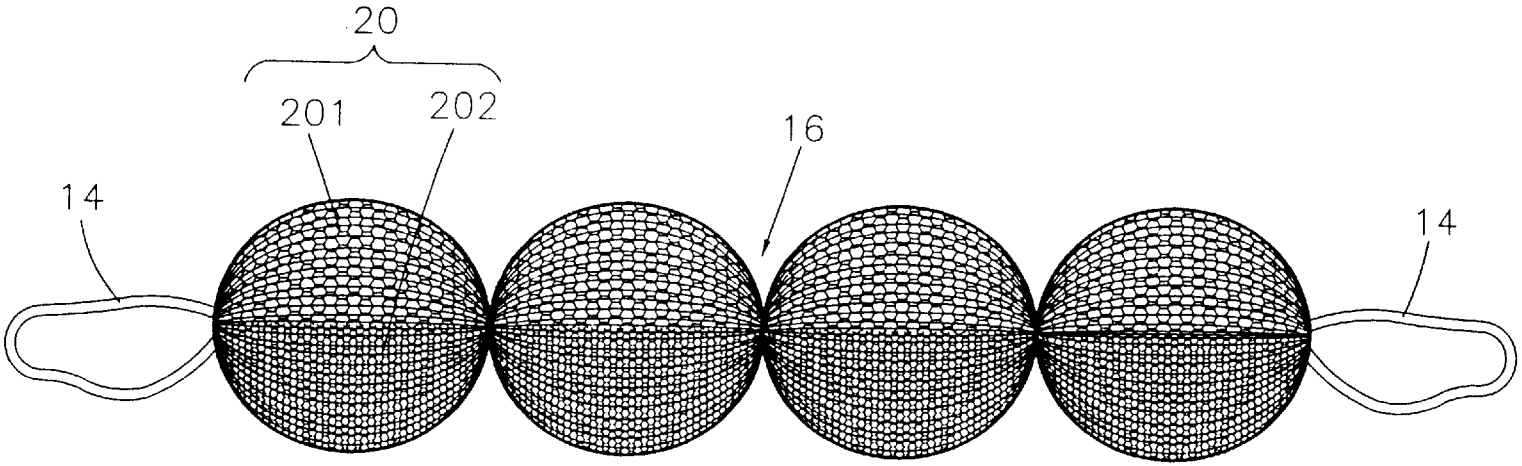
FIG. 4 is a perspective front view of a bath strip according to a second embodiment of the present invention.

FIG. 4 shows an alternate form of the present invention. According to this alternate form, the bath strip 10 is formed of two tubes of net 12 of different colors (or meshes) arranged together and tied up with the first binding elements 14 and the second binding elements 16. As illustrated, the spherical portions 20 of the bath strip 10 each is comprised of a first half 201 and a second half 202. The first half 201 and the second half 202 have different colors (or meshes). Alternatively, the bath strip 10 can be made by arranging three or more tubes of net 12 of different colors (or meshes).

Figure 5:
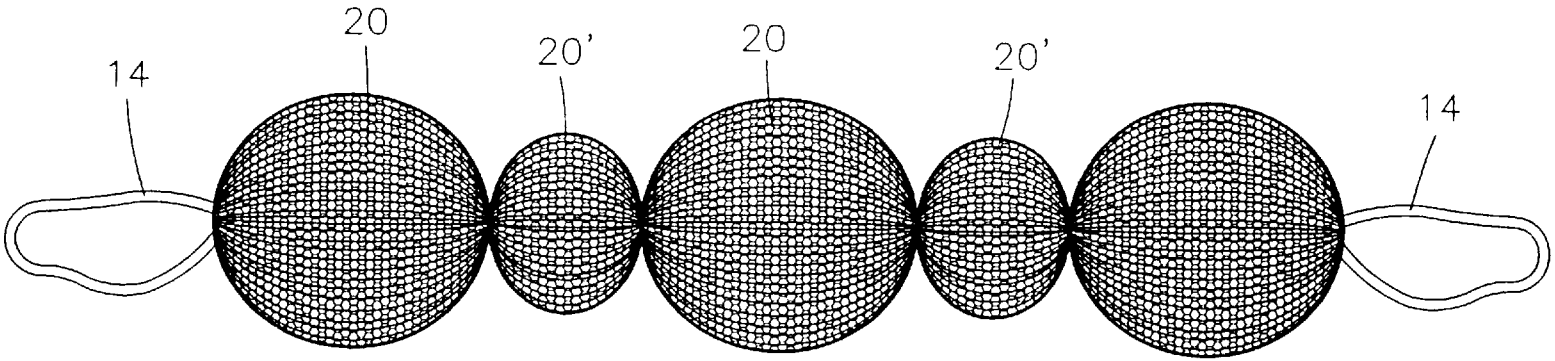
FIG. 5 is a perspective front view of a bath strip according to a third embodiment of the present invention.

FIG. 5 shows another alternate form of the present invention. According to this alternate form, a plurality of second binding elements 16 are securely fastened to the tube of net 12 and unequally spaced between the first binding elements 14. Therefore, spherical portions 20 and 20' of different sizes are formed in the bath strip 10, and connected in series.

Referring to Figures from 1 through 5 again, because the second binding elements 16 are wound around the tube of net 12 and then tied up, they are respectively retained in between each two adjacent spherical portions 20, 20'. When the bath strip 10 is rubbed over the body, the second binding elements 16 are prohibited by the spherical portions 20 and 20' from touching the skin of the body, therefore the bath strip 10 is comfortable in use.

What the invention claimed is:

1. A bath strip comprising:

an elastic tube of net transversely stretched;

two first flexible binding elements inserted through said elastic tube of net and tied up, forming two loop-like handle means at two opposite ends of the transversely stretched elastic tube of net; and a plurality of second flexible binding elements respectively wound round the transversely stretched elastic tube of net and tied up, separating the transversely stretched elastic tube of net into a longitudinal series of spherical portions.

2. The bath strip of claim 1 wherein said second binding elements are equally spaced between said first binding elements.

3. The bath strip of claim 1 wherein said second binding elements are unequally spaced from one another between said first binding elements.

4. A bath strip comprising:

a plurality of elastic tubes of net of different colors arranged together and transversely stretched;

two first flexible binding elements inserted through the arranged elastic tubes of net and tied up, forming two loop-like handle means at two opposite ends of the transversely stretched elastic tubes of net; and a plurality of second flexible binding elements respectively wound round the transversely stretched elastic tube of net and tied up, separating the transversely stretched elastic tube of net into a longitudinal series of spherical portions.

5. The bath strip of claim 4 wherein said second binding elements are equally spaced between said first binding elements.

6. The bath strip of claim 4 wherein said second binding elements are unequally spaced from one another between said first binding elements.

* * * * *